US005255786A

United States Patent [19]

McQuay

[11] Patent Number: 5,255,786

[45] Date of Patent: Oct. 26, 1993

[54] PACKAGE HAVING A SLIDING CLOSURE FOR DISPENSING PILL OR PELLET TYPE PRODUCTS

[75] Inventor: Gary E. McQuay, Watsontown, Pa.

[73] Assignee: The Procter & Gamble Company, Cincinnati, Ohio

[21] Appl. No.: 958,388

[22] Filed: Oct. 8, 1992

[51] Int. Cl.[5] ..... B65D 83/04

[52] U.S. Cl. ..... 206/534.2

[58] Field of Search ..... 206/534.1, 534.2, 540

[56] References Cited

U.S. PATENT DOCUMENTS

| | | | |
|---|---|---|---|
| 1,891,817 | 12/1932 | Hildebrand . | |
| 1,988,134 | 1/1935 | Nitardy . | |
| 2,051,009 | 8/1936 | Porter | 15/184 |
| 2,164,832 | 7/1939 | Nitardy . | |
| 2,172,547 | 9/1939 | Ruth . | |
| 2,309,111 | 1/1943 | Hothersall | 206/534.1 |
| 2,426,856 | 9/1947 | Berg | 229/20 |
| 2,692,698 | 10/1954 | Waterman | 220/41 |
| 2,722,309 | 11/1955 | Waterman . | |
| 3,018,921 | 1/1962 | Hermanson | 221/281 |
| 3,278,009 | 10/1966 | Crump, Jr. . | |
| 3,651,979 | 3/1972 | Severson | 206/534.2 |
| 4,089,413 | 5/1978 | Fukuyama | 206/382 |
| 4,614,270 | 9/1986 | Oishi | 206/389 |

*Primary Examiner*—William I. Price

*Attorney, Agent, or Firm*—Dean L. Garner; E. Kelly Linman

[57] ABSTRACT

The present invention provides a dispensing package for pill or pellet type products. The package has a sliding closure that opens and closes over an orifice to control dispensing. The package has a container for housing the pill or pellet type products. The sliding closure of the present invention has a top wall and two opposing end walls. The end walls have exterior prongs extending along them so as to slidingly engage exterior grooves on the side walls of the container. The sliding closure further includes two opposing attachment walls extending from the top wall into the interior chamber of the container. These attachment walls also have prongs that are adapted to slidingly engage interior grooves on the side walls of the container. This design allows the sliding closure to remain securely attached to the container even if the exterior prongs are disengaged from the exterior grooves.

12 Claims, 3 Drawing Sheets

PACKAGE HAVING A SLIDING CLOSURE FOR DISPENSING PILL OR PELLET TYPE PRODUCTS

FIELD OF THE INVENTION

The present invention relates to dispensing containers for pill or pellet type products. The invention has further relation to such packages having sliding closures which cannot easily be pried off by small children.

BACKGROUND OF THE INVENTION

Pill or pellet type products such as mints, aspirin, etc. are often placed in small or compact plastic packages so they may be easily carried in one's pocket, purse etc. These packages are typically rectangular or oval and have orifices for dispensing the product. The orifices are usually covered by some type of closure to keep the products from spilling when the package is not in use. One type of closure commonly used is a sliding closure. That is a closure that slides between an open position for dispensing the product and a closed position for storage. Typically the closure is a small piece of plastic mounted on the outside of the container. If the pill or pellet type product is relatively small then the orifice is usually small leading to a relatively small closure.

For such products such as mints and candies the packages can often fall into the hands of children. The closures on such packages could detach from the package either by itself or by the child forcing it off. Therefore in order to maximize the safety of such packages there has been a need to provide a pill or pellet type dispensing package having a sliding closure wherein the closure cannot be easily removed even when forced.

It is therefore an object of the present invention to provide a child safe closure for a pill or pellet type dispensing package.

It is another object of the present invention to provide such a package that has a sliding closure wherein the closure cannot be easily removed even when forced.

It is another object of the present invention to provide such a package wherein the sliding closure is of one piece construction and is inexpensive to make.

The aforementioned and other objects of the invention will become more apparent hereinafter.

SUMMARY OF THE INVENTION

In accordance with the present invention there is provided a dispensing package for a pill or pellet type product of substantially predetermined size. The package has an orifice to dispense the product and a sliding closure having an open position so as to expose the orifice and enable the product to be dispensed and a closed position so as to cover the orifice and prevent unwanted dispensing of the product. The package includes a container section having two opposing side walls having interior and exterior surfaces. The two side walls are joined by a peripheral wall wherein the side walls and the peripheral wall define an interior chamber for containing the products. The peripheral wall has an orifice therein for dispensing the products. The side walls each have at least one pair of grooves each substantially parallel and adjacent to the orifice. One of the grooves extends along the exterior of each side wall and the other groove extends along the interior of each side wall.

The package is further provided with a sliding closure comprising a top wall and two opposing end walls. Each of the end walls has at least one exterior prong protruding therefrom. The exterior prongs extend along the end walls such that they slidingly engage the exterior grooves on the side walls of the container. The sliding closure further includes two opposing attachment walls extending from the top wall and into the interior chamber. The attachment walls each have at least one interior prong protruding therefrom. The interior prongs extend along the attachment walls such that they slidingly engage the interior grooves on the side walls of the container. This design allows the sliding closure to remain securely attached to the container even if the exterior prongs are disengaged from the exterior grooves.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE PREFERRED INVENTION

Figure 1:
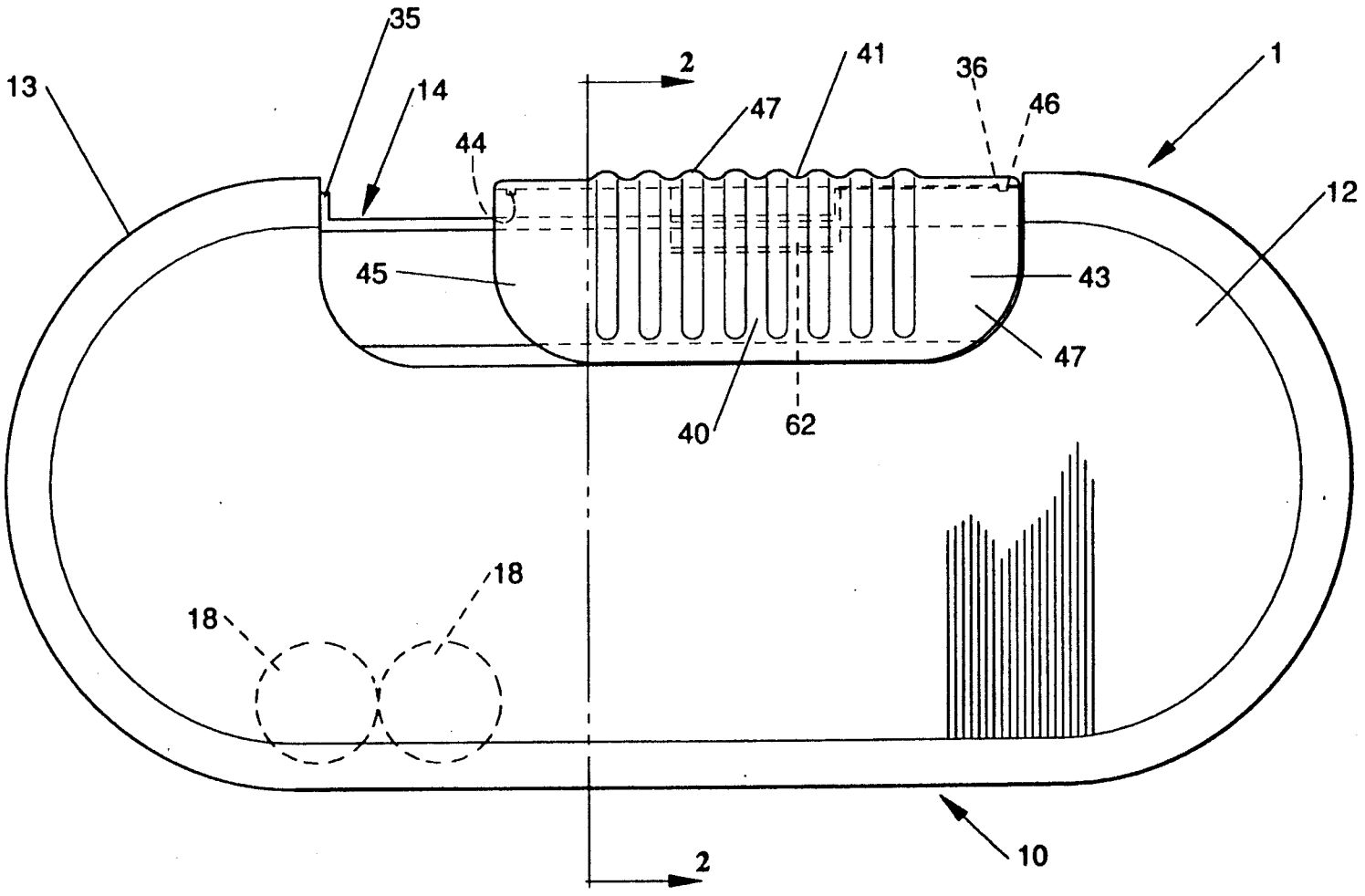
FIG. 1 is a side view of the package of the present invention.

Referring now to the drawings wherein like numerals indicate the same element throughout the views there is shown in FIG. 1 a package 1 for containing a pill or pellet type product 18. Package 1 comprises container 10 and sliding closure 40. By referring to FIG. 2 it can be seen that container 10 comprises two opposing side walls 11 and 12, and a peripheral wall 13 joining the opposing side walls 11 and 12. In the embodiment shown in FIG. 2 walls 11, 12 and 13 are made from two substantially symmetrical halves 2 and 3 made from any suitable plastic material and enjoined by welding, gluing or mechanical locking along the periphery 4 of the package 1. Half 2 comprises side wall 11 and half of peripheral wall 13, and half 3 comprises side wall 12 and the other half of peripheral wall 13. Walls 11, 12 and 13 define an interior chamber 15 for containing a number of pill or pellet type products 18. Container 10 further includes an orifice 14 (shown in FIG. 3) disposed in the peripheral wall 13 near the top of the container.

The preferred shape of package 1 is oval, as viewed from the side, however, package 1 could be rectangular, circular or any other suitable shape. Halves 2 and 3 can be made from polyolefins, polystyrene, polyethylene terephthalate or any other suitable material. In general it is preferred to have a substantially rigid container made from polyethylene terephthalate so as to prevent deformation during use and to prevent flavor migration from the plastic material to the product 18.

Side walls 11 and 12 and peripheral wall 13 all have interior and exterior surfaces. Wall 11 has exterior surface 21 and interior surface 22, wall 12 has exterior surface 23 and interior surface 24 and wall 13 has exterior surface 25 and interior surface 26. Each of the side walls 11 and 12 has at least one pair of grooves substantially parallel to and adjacent orifice 14. Side wall 11 has exterior groove 31 disposed on its exterior surface 21, and interior groove 32 disposed on its interior surface 22. Similarly, side wall 12 has exterior groove 33 disposed on its exterior surface 23, and interior groove 34 disposed on its interior surface 24. As will be explained these grooves are adapted to receive sliding closure 40.

Sliding closure 40 comprises top wall 41 and two opposing end walls 42 and 43. It is preferred that the closure 40 be of one piece construction and made from polypropylene. End wall 42 has at least one prong 51 protruding therefrom and extending along it such that it is parallel to and slidingly engages exterior groove 31 on wall 11. Similarly, end wall 43 has at least one prong 53 protruding therefrom and extending along it such that it is parallel to and slidingly engages exterior groove 33 on wall 12. Closure 40 further includes two opposing attachment walls 61 and 62 extending from top wall 41 through orifice 14 and into the interior chamber 15. Attachment wall 61 has at least one prong 72 extending along it such that it is substantially parallel to and slidingly engages interior groove 32 on side wall 11. Likewise, attachment wall 62 has at least one prong 74 extending along it such that it is substantially parallel to and slidingly engages interior groove 34 on side wall 12.

In a particularly preferred embodiment closure 40 has interference wall 63 extending from top wall 41 through orifice 14 and into interior chamber 15. Interference wall 63 prevents any pill or pellet type products 18 from being trapped between the two attachment walls 61 and 62.

In the embodiment shown in the figures the side walls 11 and 12, and peripheral wall 13 are thinner or recessed towards the top of the package near orifice 14 so that end walls 42 and 43 of closure 40 are flush with side walls 11 and 12, and top wall 41 is flush with peripheral wall 13 (as shown in FIG. 1). This makes it more difficult to pry prongs 51 and 53 from grooves 31 and 33 in an attempt to remove closure 40 from container 10. An alternative embodiment to having end walls 42 and 43 flush with side walls 11 and 12 is to have the corners 48 and 49 on walls 42 and 43, rounded so that it is more difficult for someone to pry the closure from the package.

Furthermore in a preferred embodiment closure 40 has a protrusion 44 near its leading edge 45 as shown in FIG. 1. Protrusion 44 is designed to snap fit over protrusion 35 on peripheral wall 13 adjacent orifice 14 to better secure closure 40 in its closed position. Likewise closure 40 can have a protrusion 46 near its trailing edge 47 as shown in FIG. 1. Protrusion 46 is designed to snap fit over protrusion 36 on peripheral wall 13 adjacent orifice 14 to better secure closure 40 in its open position. Lastly, closure 40 can have ribs 47 on top wall 41 to provide for better gripping.

The size of orifice 14 needs to be at least as large as a single pill or pellet type product that is being dispensed from the package 1. In a preferred embodiment it is desired that the package dispense one product at a time. This is accomplished by making the exposed portion of the orifice 14 when closure 40 is in its fully open position slightly larger than a single pill or pellet but not larger than two pills or pellets. The sliding closure 40 should be at least as large as the orifice 14 so that no portion of the product is exposed when closure 40 is in its fully closed position. The length of closure 40, therefore, needs to be at least as long as the orifice 14.

Figure 2:
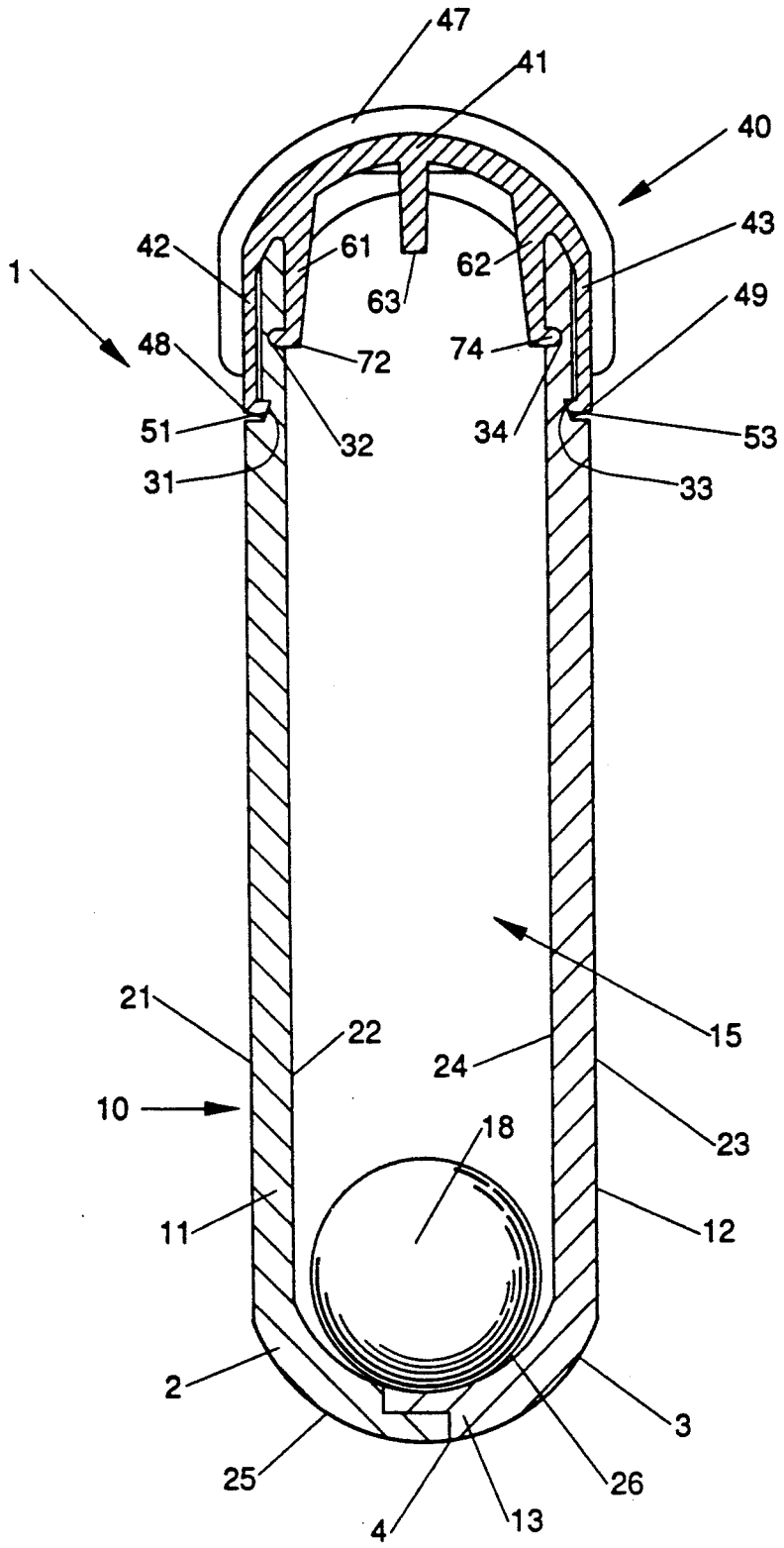
FIG. 2 is a sectional view taken along line 2—2 of FIG. 1.
Figure 3:
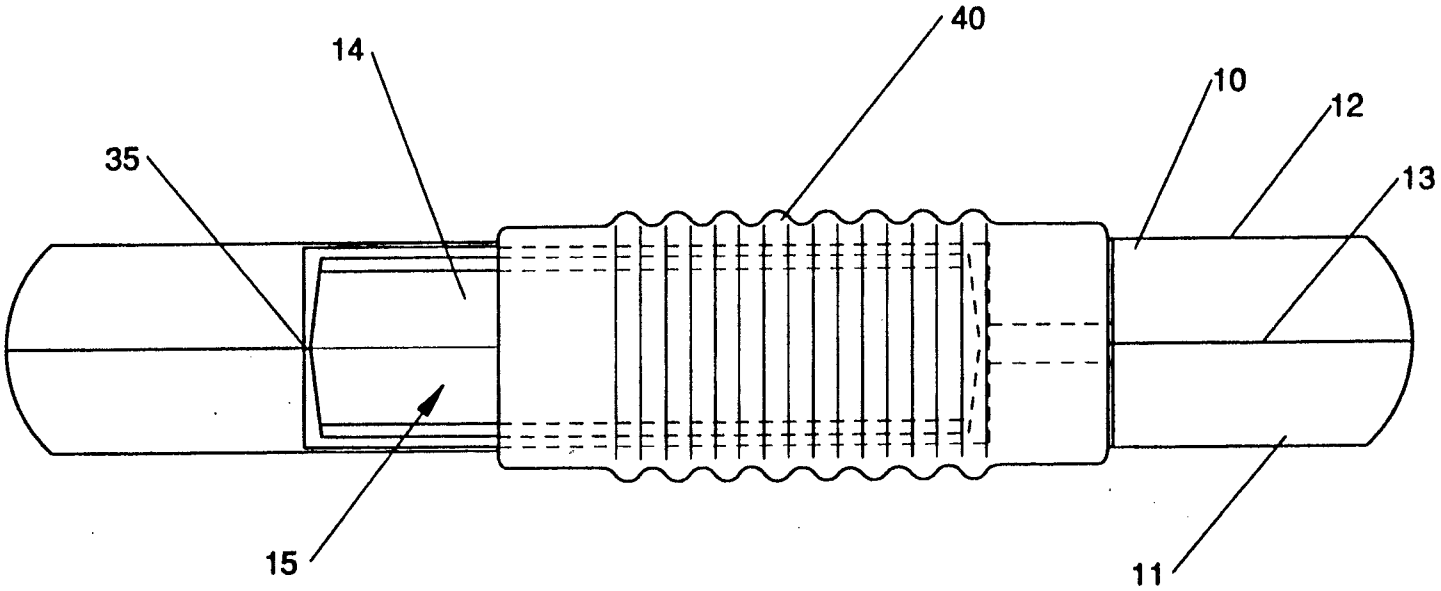
FIG. 3 is a top view of the package of the present invention.

Furthermore, for visual appearance it is desired that the product be placed in the package in a single layer. That is the distance between side walls 11 and 12 across the interior chamber 15 from interior surface 22 to interior surface 24 be such that it only holds one product as shown in FIGS. 1 and 2.

During manufacture of the package 1, a preferred method of assembly would be to have closure 40 snap-fit onto container 10. To make this easier the leading edges of prongs 51 and 52 are tapered as shown in FIG. 2. However, to prevent easy removal the trailing edges are at right angles or less to grooves 31 and 33.

The embodiment of package 1 described above has the sliding closure 40 securely attached to the container 10. If the end walls 42 and 43 were pried from their engagement with side walls 11 and 12 the closure 40 would remain securely attached to the container 10 due to the engagement of the attachment walls 61 and 62 to the interior of sidewalls 11 and 12. This ensures that the closure will not be easily detached from the container 10.

As shown and described above end walls 42 and 43 each only have one prong 51 and 53, and side walls 11 and 12 each only have one exterior groove 31 and 33. However, for even better securement and protection from prying off, end walls 41 and 42 could be designed to have any number of prongs designed to slidingly engage an equal number of exterior grooves on side walls 11 and 12. Similarly, as shown and described above attachment walls 61 and 62 each only have one prong 72 and 74, and side walls 11 and 12 each only have one interior groove 32 and 34. However, for even better securement and protection from prying off, attachment walls 72 and 74 could be designed to have any number of prongs designed to slidingly engage an equal number of interior grooves on side walls 11 and 12.

While particular embodiments of the present invention have been illustrated and described various modifications will be apparent to those skilled in the art without departing from the spirit and scope of the present invention. Accordingly, the scope of the present invention should be considered in terms of the following claims and is understood not to be limited to the details described and shown in the specification and drawings.

What is claimed is:

1. A dispensing package for pill or pellet type products of a substantially predetermined size, said package having an orifice to dispense said product, said package further comprising a sliding closure having an open position so as to expose said orifice and enable said product to be dispensed and a closed position so as to cover said orifice and prevent unwanted dispensing of said products, said package comprising:

(a) a container comprising two opposing side walls having interior and exterior surfaces and a peripheral wall joining said opposing side walls, said side walls and said peripheral wall defining an interior chamber for containing said products, said peripheral wall including an orifice therein for dispensing said products therefrom, said side walls each having at least one pair of grooves substantially parallel to and adjacent said orifice, one of said grooves extending along said exterior of said side wall and said other groove extending along said interior of said side wall; and (b) said sliding closure comprising a top wall and two opposing end walls, each of said end walls having at least one exterior prong protruding therefrom, said exterior prongs extending along said end walls such that they slidingly engage said exterior grooves on said side walls of said container, said sliding closure further including two opposing attachment walls extending from said top wall and into said interior chamber, said attachment walls each having at least one interior prong protruding therefrom, said interior prongs extending along said attachment walls such that they slidingly engage said interior grooves on said side walls of said container, whereby said sliding closure remains securely attached to said container even if said exterior prongs are disengaged from said exterior grooves.

2. The package according to claim 1 wherein said package includes a means to secure said sliding closure in its closed position.

3. The package according to claim 2 wherein said means to secure said closure in its closed position comprises a protrusion on said top wall of said closure designed to snap fit over a protrusion on said peripheral wall of said container when said closure is in its closed position.

4. The package according to claim 1 wherein said end walls of said closure are flush with said side walls of said container.

5. The package according to claim I wherein said top wall of said closure is flush with said peripheral wall of said container.

6. The package according to claim 1 wherein the exposed portion of said orifice when said sliding closure is in its fully open position is larger than a single pill or pellet type product but smaller than two pill or pellet type products so that said package dispenses said products one at a time.

7. The package according to claim 1 wherein said distance between said opposing end walls of said container is such that only one layer of pill or pellet type products can be disposed between said end walls.

8. The package according to claim 1 wherein said closure further comprises an interference wall extending from said top wall and into said interior chamber between said attachment walls.

9. The package according to claim 1 wherein said closure is of one piece construction formed from polypropylene.

10. The package according to claim 1 wherein said exterior prongs on said end walls of said closure have leading edges that are tapered, whereby said closure is easily snap fitted onto said container.

11. The package according to claim 10 wherein said exterior prongs on said end walls of said closure have trailing edges that make at most a 90° angle with said exterior grooves on said side walls of said container.

12. The package according to claim 1 wherein said end walls of said closure and said exterior prongs on said end walls are joined at a rounded edge.

* * * * *